United States Patent [19]

Fiveash

[11] Patent Number: 4,602,393

[45] Date of Patent: Jul. 29, 1986

[54] BATHTUB LINER

[76] Inventor: Daniel E. Fiveash, P.O. Box 1123, Big Spring, Tex. 79720

[21] Appl. No.: 690,847

[22] Filed: Jan. 18, 1985

[51] Int. Cl.[4] ..... A47K 3/02

[52] U.S. Cl. ..... 4/580; 4/661; 4/DIG. 18; 4/583

[58] Field of Search ..... 4/580, 583, 661, DIG. 18

[56] References Cited

U.S. PATENT DOCUMENTS

| | | | |
|---|---|---|---|
| 2,264,672 | 12/1941 | Levine | 4/580 |
| 2,853,714 | 9/1958 | Darmstadt | 4/580 |
| 3,133,292 | 5/1964 | Spier | 4/580 |
| 3,892,000 | 7/1975 | Morse | 4/580 |
| 3,931,652 | 1/1976 | Navarra | 4/580 |
| 4,051,563 | 10/1977 | Clarke, Jr. | 4/580 |

*Primary Examiner*—Henry K. Artis

*Attorney, Agent, or Firm*—Pastoriza, Kelly & Lowry

[57] ABSTRACT

An integral sheet of plastic material is shaped to conform to the bottom, sides, vertical one end and sloping other end of a bathtub. The upper edges of the sheet extend beyond the upper edges of the bathtub so that the depth of the liner is greater than the depth of the bathtub thereby lessening the risk of water splashing over the edge of the bathtub. The liner includes a drain opening in its floor positioned to overlie the bathtub drain opening so that water can be drained from the liner. An open ended cylindrical container is provided to store the liner when not in use.

5 Claims, 4 Drawing Figures

BATHTUB LINER

FIELD OF THE INVENTION

This invention relates generally to bathtubs and more particularly to an improved liner for a bathtub.

BACKGROUND OF THE INVENTION

It has been known for some time to provide liners for bathtubs. Generally, such liners are for the purpose of increasing the comfort of the bather as well as serving to prevent slipping and similar accidents in the bathtub.

U.S. Pat. Nos. 2,264,672 and 2,495,602 both disclose cushion-type linings for bathtubs.

U.S. Pat. No. 579,532 in turn illustrates a bathtub mat, the mat also including side portions for providing a cushioning effect.

None of the liners in the above patents nor in any other prior art of which I am aware serves to increase the effective depth of the bathtub and at the same time provide the various advantages of a liner. More particularly, with liners as presently known, the top edges of the bathtub remain the same height so that problems of children splashing water onto the bathroom floor still exist. In U.S. Pat. No. 4,069,523 there is disclosed a bathtub provided with a cushioned liner. In the disclosure of this patent there are referenced splash panels which cover three sides of the bathtub to protect the adjacent three dimensional wall areas from water. However, the fourth long side of the tub open to the bathroom floor is not affected by such panels and thus the disadvantage of splashing water is still present.

U.S. Pat. No. 3,045,254 shows a liner for a bathtub which is more or less a permanent fixture in the bathtub in that the upper edge of the liner is held in place by the bathtub wall tiles. Again, while the "liner" does extend slightly above the top edge of the bathtub, such occurs only at the portions of the bathtub edge adjacent wall surfaces and not along the long side of the bathtub to which access is attained and which side is the important one to inhibit splashing.

BRIEF DESCRIPTION OF THE PRESENT INVENTION

With the foregoing in mind, the present invention contemplates the provision of an improved bathtub liner wherein the liner itself will inhibit splashing of water on the bathroom floor about four sides of a bathtub as well as serve to increase the effective depth of the bathtub.

More particularly, in its broadest aspect, the bathtub liner of this invention comprises an integral sheet of plastic material shaped to conform to the bottom, sides, vertical one end and sloping other end of the bathtub. The upper edges of the sheet extend beyond the upper edges of the bathtub so that the depth of the liner is greater than the depth of the bathtub thereby lessening the risk of water splashing over the edges of the bathtub. The liner further includes a drain opening on its floor positioned to overlie the bathtub drain opening so that water can be drained from the liner.

In the preferred embodiment there is also provided a storage container for the liner as part of an overall combination.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
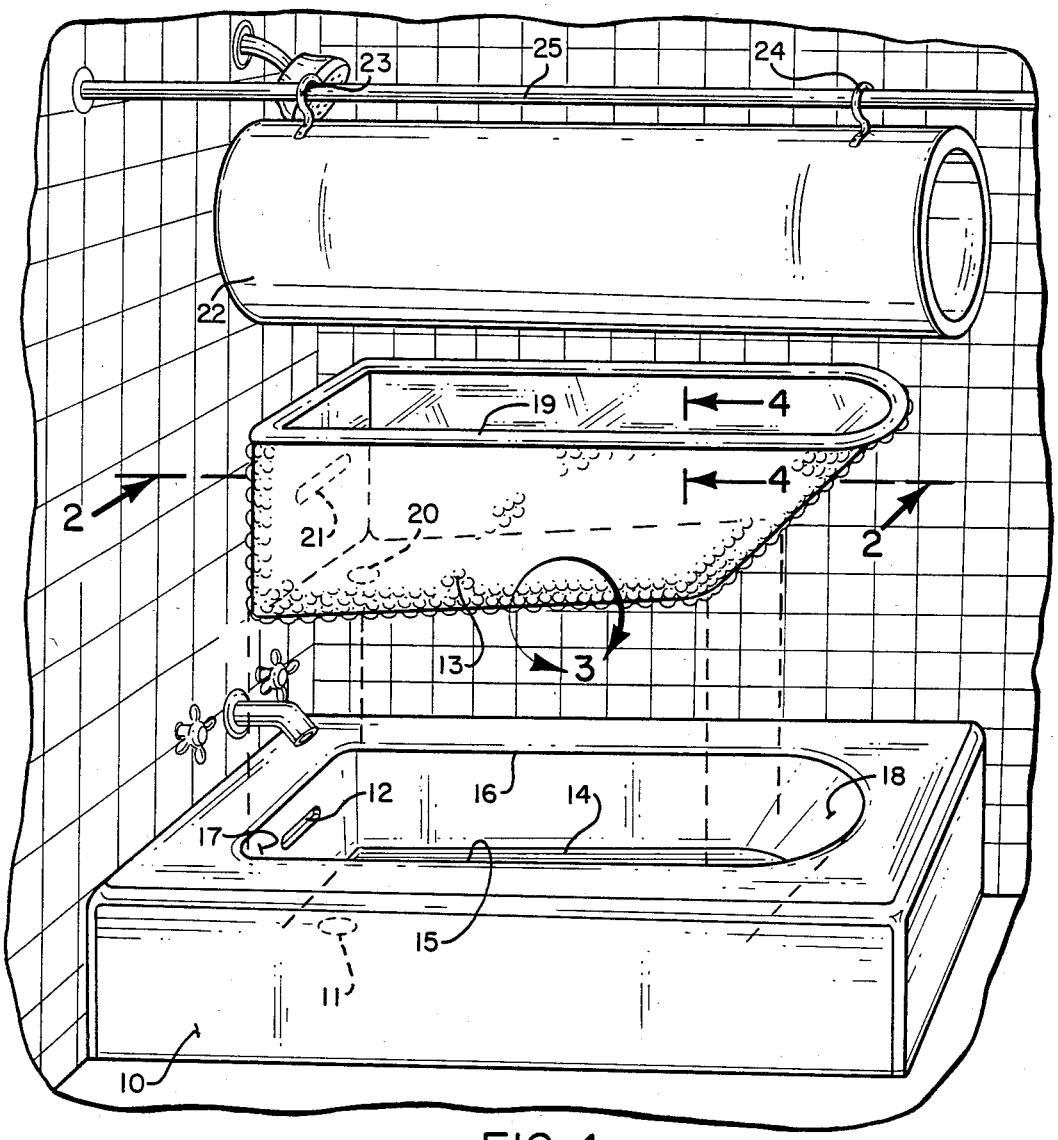
FIG. 1 is a fragmentary perspective view of a conventional bathtub showing the improved liner of this invention in exploded relationship above the bathtub. Also shown is a storage container for the liner.

Referring to FIG. 1, there is shown a conventional bathtub 10 with an outlet drain 11 shown in phantom lines and an overflow opening 12.

Shown exploded above the bathtub 10 is the liner 13 of this invention. Liner 13 comprises an integral sheet of plastic material shaped to conform to the bottom 14 of the bathtub, the two sides 15 and 16, the vertical one end 17 and the sloping other end 18. However, the liner is designed such that the upper edges of the sheet extend beyond the upper edges of the bathtub so that the depth of the liner is greater than the depth of the bathtub.

Figure 2:
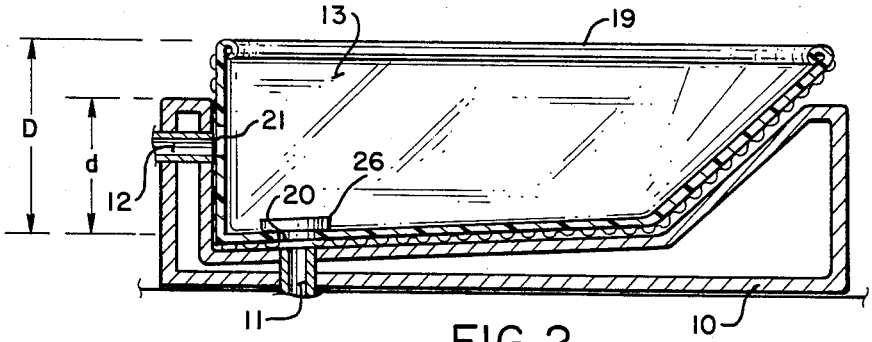
FIG. 2 is a cross-section taken in the direction of the arrow 2—2 of FIG. 1 but showing the position of the liner in the bathtub itself.

The foregoing can better be seen in the cross-section of FIG. 2 wherein the depth of the liner is indicated by the letter D while the depth of the bathtub is indicated by the letter d. The extending upper edges of the sheet beyond the upper edges of the bathtub further lessen the risk of water splashing over the edge of the bathtub and on to the floor. In this respect it should be noted that the extending upper edges of the sheet follow around the complete periphery of the bathtub.

In order that the upper edges constituting the extending portion of the sheet be fairly stable, these edges are rolled as indicated at 19 in both FIGS. 1 and 2. Essentia11y, this roll will help the liner hold its shape but yet the same will still be sufficiently flexible that it can be manually bent down over the adjacent edge of the bathtub to facilitate entrance or access to the interior of the liner all as will become clearer as the description proceeds.

Still referring to FIG. 1, as indicated by the phantom lines the liner 13 is provided with a drain opening 20 on its floor positioned to overlie drain 11 of the bathtub when the liner is in position. Also, the liner 13 is provided with an overflow opening 21 also positioned to register with the opening 12 of the bathtub when the liner is in position. The opening 21 can be formed by cutting along the vertical top portion of the liner and then down the left and right sides and leaving the bottom horizontal portion so that a flap is defined. This flap can be pushed into the overflow opening of the bathtub and thereby inhibit leaking of any water down between the exterior of the liner and the interior of the bathtub.

Referring now to the upper portion of FIG. 1 there is shown at 22 an open ended cylinder supported as by hooks 23 and 24 to the shower curtain rod for the bathtub indicated at 25. The hooks 23 and 24 are removeable from the open ended cylinder 22 for shipping purposes.

It will be understood that the liner can simply be removed from the tub and manually collapsed because of its flexible nature into an elongated configuration receiveable in one of the open ends of the cylinder. The open ends will permit the liner to dry.

Referring again to FIG. 2, there is shown a stopper 26 which is provided for the liner, the normal bathtub drain 11 being left open.

It will be noted in both FIGS. 1 and 2 that the bottom and preferably the outer sides of the liner 13 have a series of small projections. The opposite sides of the liner itself; that is, the interior side is smooth for maximum comfort to a person using the liner.

Figure 3:
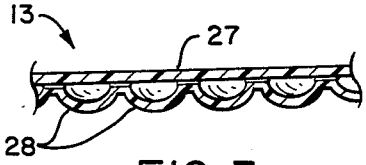
FIG. 3 is an enlarged fragmentary cross-section of a portion of the bottom of the liner enclosed within the circular arrow 3 of FIG. 1; and, FIG. 4 is a fragmentary cross-section taken in the direction of the arrows 4—4 of FIG. 1 again taken when the liner is positioned in the bathtub.

The enlarged fragmentary cross-section of FIG. 3 illustrates the referred to smooth inner surface 27 and projections 28 on the bottom of the liner. These projections are positioned to leave open channels there between so that any water trapped between the exterior of the liner and the interior of the bathtub can flow out the bathtub drain.

In the preferred embodiment set forth, the projections are defined by hollow chambers in the shape of hemispheres filled with air thereby providing a cushioning effect to increase the comfort of a bather. Also, the use of the air "bubbles" increases insulation so that heat in the water is retained longer than would be the case in the absence of the projections.

Figure 4:
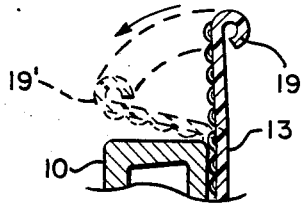

In the fragmentary cross-section of FIG. 4, there is shown the upper rolled edge 19 of the liner 13 and it will be noted as mentioned heretofore that the same can be manually urged downwardly to the phantom line position 19' as indicated. By flexing the edge of the liner downwardly, access to a child in the bathtub is facilitated and/or, entry of a person to and from the bathtub is facilitated. As mentioned, the resilience of the plastic is such that it will snap back to its original shape when any pressure tending to lower its edge portion is relieved. As also mentioned, the rolled upper edge 19 lends strength to the overall structure.

From all of the foregoing, it will now be evident that the present invention has provided a greatly improved bathtub liner having a specific advantage of effectively increasing the depth of the bathtub and also inhibiting the splashing of water on the bathroom floor.

Various changes falling within the scope and spirit of this invention will occur to those skilled in the art. The bathtub liner is therefore not to be thought of as limited to the exact embodiment set forth for illustrative purposes only.

I claim:

1. A bathtub liner comprising:

(a) an integral sheet of plastic material shaped to conform to the bottom, sides, vertical end and sloping other end of a bathtub, (b) the upper edges of the sheet extending beyond the upper edges of the bathtub so that the depth of the liner is greater than the depth of the bathtub thereby lessening the risk of water splashing over the edge of the bathtub, (c) said liner having a drain opening in its floor positioned to overlie the bathtub drain opening so that water can be drained from the liner, and (d) the inside surface of the liner being relatively smooth and the outside surface including an array of relativey small projections to leave open channels between the projections so that any water trapped between the outside surface of the liner and the interior of the bathtub can flow through siad channels to said bathtub drain opening.

2. A liner according to claim 1, in which said bathtub includes an overflow opening in its said vertical one end and in which said liner includes an overflow opening positioned to register with the overflow opening in said bathtub.

3. A liner according to claim 1, including, in combination: a storage device in the form of an open ended cylinder for receiving said liner when not in use; and hook means for supporting said cylinder to the shower curtain rod for said bathtub.

4. A liner according to claim 1, in which the said projections are defined by hollow chambers in the form of hemispheres filled with air, thereby providing a cushioning effect to increase the comfort of a bather and also providing heat insulation so that the heat of water in the liner is retained longer than in the absence of such projections.

5. A liner according to claim 1, in which the tops of the upper edges of the liner are rolled to help hold the shape of the extending edges, said edges still being sufficiently flexible that they can be bent down over the corresponding edge of the bathtub to facilitate access to the interior of the liner.

* * * * *